United States Patent [19]

Scripps

[11] Patent Number: 4,812,827

[45] Date of Patent: Mar. 14, 1989

[54] DETECTOR AND LIGHT ASSEMBLY

[76] Inventor: Keith A. Scripps, 4301 Massachusetts Ave., NW., Washington, D.C. 20016

[21] Appl. No.: 120,956

[22] Filed: Nov. 16, 1987

Related U.S. Application Data

[63] Continuation-in-part of Ser. No. 935,219, Nov. 29, 1986, Pat. No. 4,717,910, and a continuation-in-part of Ser. No. 797,008, Nov. 12, 1985, Pat. No. 4,694,285.

[51] Int. Cl.[4] ..... G08B 23/00

[52] U.S. Cl. ..... 340/693; 340/628; 340/691; 340/586; 367/197

[58] Field of Search ..... 340/693, 628, 691, 584, 340/586, 531, 538, 310 CP; 367/197–199

[56] References Cited

U.S. PATENT DOCUMENTS 4,090,178 5/1978 Norris ..... 340/693

4,365,237 12/1982 Knight ..... 340/596

4,417,235 11/1983 Del Grande ..... 340/531

*Primary Examiner*—Donnie L. Crosland

*Attorney, Agent, or Firm*—Sixbey, Friedman, Leedom & Ferguson

[57] ABSTRACT

The detector assembly combines an electrically powered detector and alarm and an electrical light into a single unit which is removably attachable to a conventional electrical receptacle. The unit includes a closed housing containing a detector and alarm system, and recessed within the housing is a light bulb socket for reception of a light bulb into a face of the housing. Protruding from an opposite face of the housing is an electrical connector capable of removable attachment to a standard electrical receptacle. A sound transmitter in the housing may transmit audible alarm signals to a remote receiver, which may be mounted in another detector assembly at a remote location to cause this detector assembly to emit alarm signals.

28 Claims, 5 Drawing Sheets

DETECTOR AND LIGHT ASSEMBLY

This application is a continuation-in- part application of copending parent application Ser. No. 935,219 filed on Nov. 29, 1986, by Keith A. Scripps and Thomas C. Driggers, now U.S. Pat. No. 4,717,910 and entitled Detector And Light Assembly, and such parent application being a continuation-in-part application of Ser. No. 797,008 filed on Nov. 12, 1985, by Keith A. Scripps, now U.S. Pat. No. 4,694,285 and entitled Combination Electrical Light, Smoke And/Or Heat Detector.

TECHNICAL FIELD

The present invention relates generally to alarm detectors for sensing the occurrence of a dangerous condition and providing an alarm indicative of the presence of the condition, and more particularly to a detector combined with a conventional electric light and/or other electrical sensing device and adapted to be mounted in any conventional electric receptacle.

BACKGROUND ART

Property loss, personal injury and loss of life due to fire can often be minimized or avoided when smoke or heat detectors are employed to provide an alarm during the initial stages of a fire. Consequently, local law in many jurisdictions requires that smoke and heat detectors with alarms be provided in public and commercial buildings and private homes. This has led to the development of a wide variety of commercially available smoke and heat detectors which are battery operated or are wired into the electrical circuit for a building.

The least expensive gas, heat and smoke detectors are battery operated, and these units m ay be permanently installed upon walls or ceilings in an area to be protected. The batteries in these units must be periodically replaced, and generally such units provide an intermittent alarm signal when the battery charge drops below a predetermined level. U.S. Pat. No. 4,227,191 to Samuel Raber illustrates a battery powered smoke detector of this type. Unfortunately, homeowners are prone to remove a weak battery from a smoke detector to silence the low charge warning signal and then neglect to promptly replace the battery. Also, some local laws require that smoke and heat detectors be wired into the 110 V power supply for a building, and in such cases, battery powered units are unacceptable.

Smoke, gas, and heat detectors which are wired into a building power supply are normally permanent installations which must be installed by a qualified electrician, and these units operate continuously on the available house power supply. To preclude the likelihood that such permanently wired detectors will be rendered inoperative by a fire which rapidly disables the building power supply, it is conventional practice to provide these units with battery power from a battery which is recharged from the standard A.C. power supply. If this power supply is discontinued, the detector will continue to operate as long as battery power remains. Such a system is disclosed by U.S. Pat. No. 4,199,754 to R. W. Johnson and W. J. Raddi.

Fire detectors which are wired into a standard household A.C. power supply generally require a separate outlet box for each detector which is installed. In an attempt to eliminate this necessity, combination smoke detector and lamp structures have been provided which can be wired into a single outlet box such as the one installed for a conventional ceiling lamp. Such a structure is illustrated by U.S. Pat. No. 4,090,178 to E. G. Norris.

A common problem experienced with both battery powered and hard wired A.C. powered fire detectors is that they are, in all cases, a permanent installation. If such a detector is inadvertently placed too close to a stove or other source of normal and acceptable smoke or heat, the alarm will be triggered, and the detector must then be either moved to an acceptable location or deactivated and replaced by a new detector. Movement of a fire detector generally involves substantial inconvenience, for wall or ceiling surfaces which have been defaced by the detector mounting must be repaired and repainted, and often the services of an electrician are required to disconnect and reinstall the detector. To eliminate these problems, some attempts have been made to power detectors from existing light sockets, as disclosed by U.S. Pat. No. 4,365,237 to W. B. Knight. Although circuits of this type do operate effectively from a conventional bulb socket, they are unsuitable for use with ceiling sockets as they require the additional mounting surfaces which are provided with a table or floor lamp. This is due to the fact that the detector module constitutes a separately mounted module which is electrically powered from a lamp module but which is otherwise separate and distinct therefrom. In systems of this type, there is no electrical cooperation between the light and detector circuit which operate as independent elements.

The above problems which are inherent in conventional fire detectors, which are the most common type of detectors, are also prevalent in other types of electrically powered detectors.

DISCLOSURE OF THE INVENTION

It is a primary object of the present invention to provide a novel and improved detector with alarm which can be easily inserted or removed from a conventional electrical receptacle.

Another object of the present invention is to provide a novel and improved detector with combination light and alarm wherein both the light holder and detector unit constitute a unitary assembly which can be easily inserted or removed from a conventional electrical receptacle. An incandescent light may be inserted into a socket in the detector unit and may be operated in a conventional manner.

A further object of the present invention is to provide a novel and improved detector with a combination audio and sound transmission alarm system. The audio alarm is activated in response to an alarm condition and the sound is picked up by a sound transmission unit and transmitted to a remote location.

Yet another object of the present invention is to provide a novel and improved detector with combination light and alarm which includes a light operating switch for a light mounted in the detector unit so that house power can be constantly provided to the detector unit, and the operation of the light may be independently controlled by the detector unit light operating switch.

A still further object of the present invention is to provide a novel and improved detector with combination light and alarm which may both be mounted and connected to house power solely by insertion of a male electrical mounting unit for the detector into a conventional female electrical receptacle. The male electrical mounting unit may be a conventional two prong plug or another type of male electrical connector.

These and other objects of the present invention are accomplished by providing a detector with alarm which includes a housing having a projecting electrical mount and connector assembly adapted for reception by conventional female electrical receptacles such as the receptacle for a two or three prong plug or conventional incandescent light sockets. The housing may include a light socket to receive a removable incandescent electric light bulb. Operation of the light bulb is controlled by a manual switch included in electrical control circuitry for the unit, and in an alarm condition, the incandescent light continues to operate normally. Mounted within the housing is a detection unit, which may be a heat detector, smoke detector, gas detector, radiation detector or other suitable detector which provides a fire or other detection function and which may be powered from either house power from the projecting m ale mount and connector assembly or from battery power provided by a standby battery mounted within the housing. The standby battery is charged by a charger unit connected to the male mount and connector assembly. A sound transmission device is mounted within the housing to transmit an audio alarm signal provided by the detector unit to a remote location.

BEST MODE FOR CARRYING OUT THE INVENTION

Figure 1:
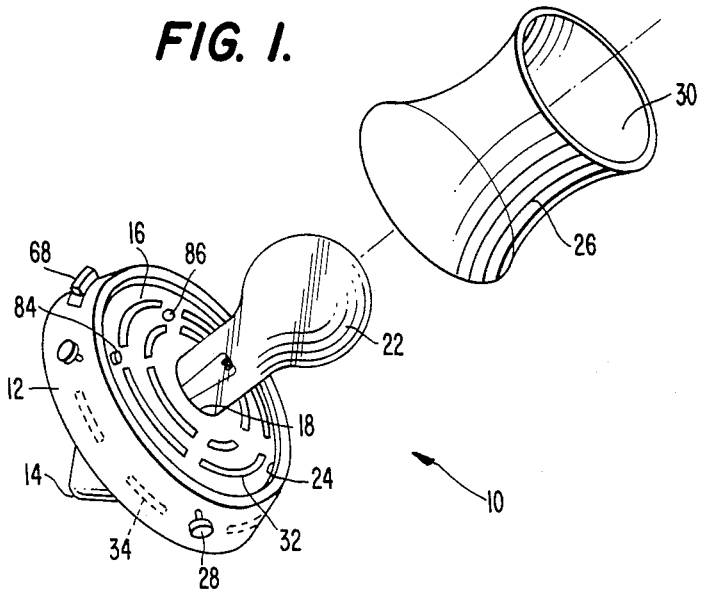
FIG. 1 is a perspective exploded view of the detector with combination lamp and alarm of the present invention.

A preferred embodiment of the detector with light assembly of the present invention is indicated generally at 10 in FIG. 1. This assembly includes a housing 12 having a projecting threaded mount and connector assembly 14 which is identical to the base portion of a conventional incandescent light bulb. The wall 16 of the housing opposite to the mount 14 includes a threaded socket 18 which is a unitary part of the threaded mount and connector assembly, and this socket receives the threaded base 20 of an incandescent bulb 22. Extending outwardly from the wall 16 of the housing is a circular lip 24 within which a conventional lamp cover 26 may be removably mounted by screws 28. Preferrably, the lamp cover 26 in a smoke or gas detector has an open end 30 so that smoke or gas can pass through the open end and into slots 32 formed in the wall 16. However, if the lamp cover has a closed end, slots 34, shown in dotted lines in FIG. 1, may be cut in the sides of the housing 12 to admit smoke or gas.

Figure 2:
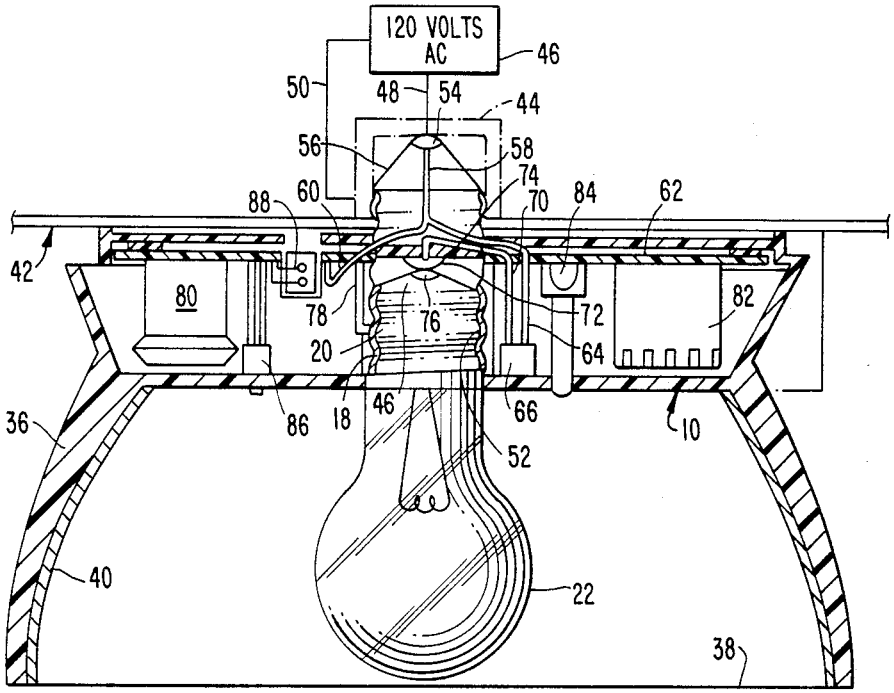
FIG. 2 is a partially diagrammatic section a view of the detector with combination lamp and alarm of FIG. 1.

The detector housing 12 and the lamp cover 26 can be constructed as a one-piece unit as illustrated in FIG. 2. Here, the lamp cover may take the form of a reflector or shade 36 having an open side 38 of sufficient area to facilitate removal and replacement of the light bulb 22. This design is quite versatile, and the shade 36 can take many different forms. For overhead use, the shade could be molded as a curved reflector having a light reflecting inner surface 40. Alternatively, the shade could be ornamental and possibly translucent to serve as a conventional light shade when the detector assembly 10 is mounted in a conventional table or floor lamp.

For purposes of illustration in FIG. 2, the detector with light assembly 10 is mounted below a ceiling 42 by means of a conventional ceiling fixture indicated in broken lines at 44. This ceiling fixture includes a light socket unit mounted on a recessed junction box which provides power from the house power supply 46 by means of conductors 48 and 50 to the light socket unit. Such an arrangement is typical in most residences and commercial buildings and is therefore diagrammatically illustrated in FIG. 2.

The threaded mount and connector assembly 14 is screwed into the light socket unit of the ceiling fixture 44 to not only mount the detector and light assembly 10 on the ceiling 42 but also to electrically connect the unit with the power supply 46. Thus, the detector and light assembly may be easily installed and removed.

Figure 3:
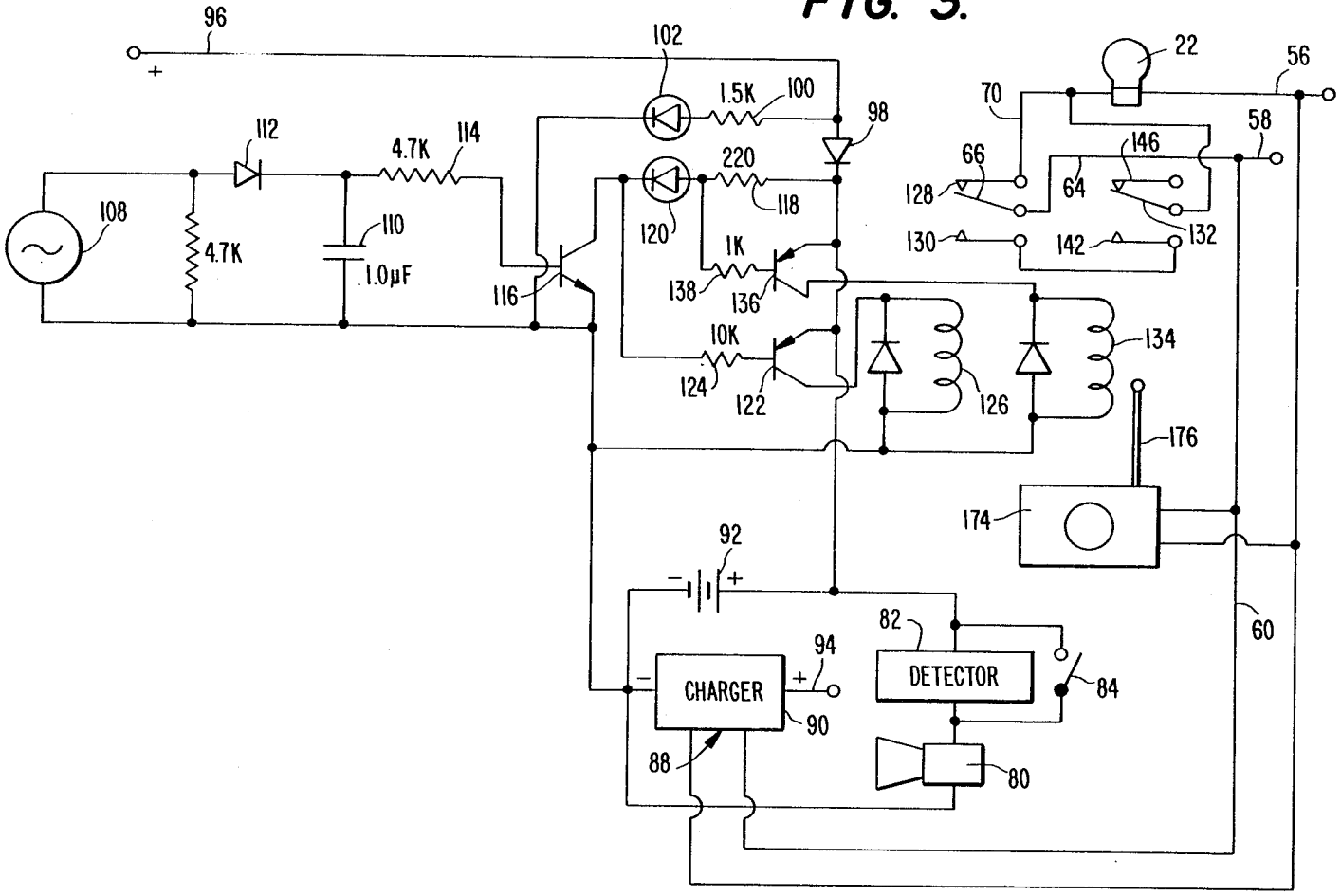
FIG. 3 is a circuit diagram of the electrical control circuit for the detector with combination lamp and alarm of FIG. 1.

In connection with FIG. 2, the general electrical circuit path through the detector and light assembly is shown in a very basic form for purposes of description, and an accurate circuit diagram of the operative circuit is disclosed in FIG. 3. Once the threaded mount and connector assembly 14 is installed in electrical contact with the ceiling fixture 44, a circuit is completed from the conductor 50 and a conductive sidewall of the light socket unit for the ceiling fixture 44 to a conductive sidewall 52 of the threaded mount and connector assembly. A circuit is also completed from the conductor 48 to a fixture contact 54 positioned at the end of the threaded mount and connector assembly. This fixture contact is separated from the conductive sidewall 52 by an insulation cone 56, so that there is no electrical circuit between the two.

A conductor 58 extends from the fixture contact 54 and splits to provide a first power supply circuit 60 to a detector circuit board 62 and a second power supply circuit 64 to a switch 66. The switch 66 is manually operated by a switch button 68 extending outwardly from the housing 12, or by a pull chain or other known switch actuator. This switch selectively completes or breaks a circuit over a conductor 70 to a bulb socket contact 72 which is mounted within the threaded socket 18 by an insulating divider 74. When the light bulb 22 is screwed into the socket 18, a bulb contact 76 on the threaded base 20 contacts the bulb socket contact 72. Now, when the switch 66 is activated to complete a circuit, current flows from the bulb contact to the filament and back to the conductive bulb threaded base and to the conductive sidewall 52 of the threaded socket 18.

The detector circuit board 62 includes the detector and alarm components of the detector and light assembly 10 as well as the control circuitry therefor. These elements are powered from the first power supply circuit 60, and the circuit for the detector circuit board is completed by a return line 78 which electrically connects the circuit board to the conductive sidewall 52.

The detector circuit board is doughnut-shaped to fit around the threaded socket 18 and supports an alarm horn 80, a detector 82 for smoke, heat, gas, radiation or some other condition which will result in an alarm condition, a test button assembly 84, and a pilot light 86. A battery circuit 88 is also mounted on the detector circuit board and includes a rechargeable battery and battery charger to provide a power supply for the detector 82 and the alarm horn 80.

In FIG. 3, it will be noted that the battery circuit 88 includes a battery charger 90 and a battery 92 which may be a rechargeable nickel cadmium battery. These units are in a circuit with the detector 82 and the alarm horn 80, so when the detector closes the circuit to the battery, the horn is energized. To test the battery, the test button assembly 84 may be activated to close a shunt circuit to the horn around the detector 82.

The detector and battery circuit can be one of a number of known commercial circuits where a detector closes a circuit from a battery to an alarm device upon the detection of a specific condition. The control circuit of FIG. 3, which assumes control of the energization of the light bulb 22 when the horn 80 is activated, may be used with most battery operated detector circuits.

As previously indicated, power is provided from the conductor 58 over a first power supply circuit 60 to a detector circuit board 62, and this power is provided to the battery charger 90 mounted on the circuit board. To maintain the charge on the battery 92, the positive terminal 94 of the battery charger is connected to a power input line 96 which is connected to a Schottky diode 98, a resistor 100 and an LED 102. Since the diode 98 has a low forward drop characteristic, current is provided across the diode to maintain the charge on the battery 92. However, the diode 98 prevents the battery from discharging across the resistor 100 and LED 102.

When the horn 80 is not activated, current from the input line 96 passes across the resistor 100 and the LED 102 to the negative terminal of the battery charger 90. This illuminates the LED 102 which, with an LED 120, forms the pilot light 86.

Activation of the horn 80 causes a sonically activated transducer 108 to charge a capacitor 110 across a diode 112. Normally, the transducer opens the circuit to the capacitor, but operates to provide power in response to the sonic signal from the horn. The use of a sonically activated transducer permits the control circuit of FIG. 3 to be combined with a variety of battery powered detector and alarm circuits without requiring a number of complex electrical connections. However, the transducer 108 could be replaced by a switching circuit which is connected to close when power is provided to the horn 80 so that the capacitor 110 begins to charge.

The charge on the capacitor 110 developed across a base resistor 114 will ultimately reach a level where a transistor 116 begins to conduct. Current now passes over a resistor 118 and a blinking LED circuit 120 to the conducting transistor 116. The blinking LED circuit is a commercial circuit which flashes on and off as long as current is provided thereto, thus causing the LED to blink and a perdiodically interrupted flow of current to pass across the transistor 116. Other known flasher circuits could be substituted for the LED circuit 120.

The conduction of the transistor 116 initially causes a transistor 122 to conduct, and since the base resistor 124 for the transistor 122 is connected directly to the collector of the transistor 116, the transistor 122 will conduct without interruption while the transistor 116 is conducting. This results in the energization of a solenoid coil 126 for a solenoid switch which includes the switch arm 66. If the switch 66 is manually activated to energize the light 22 by completing a circuit to a switch contact 128 as shown in FIG. 3, energization of the coil 126 will move the switch arm into engagement with a contact 130. On the other hand, if the switch arm has been manually positioned to deengergize the light 22 and thus is already engaged with the contact 130, the energization of the coil 126 will not affect the position of the switch arm.

Once current through the conducting transistor 122 has energized the coil 126 to insure that a circuit is completed from the second power supply circuit 64 to the contact 130, power may be supplied to the light 22 by a reciprocating solenoid switch 132. This switch is operated by a coil 134 which is energized by the conduction of a transistor 136. The transistor 136 is also triggered into conduction by the conduction of the transistor 116, but since current across the base resistor 138 for this transistor must pass across the blinking LED circuit 120, the conduction of the transistor is intermittent in response to the current pulses across the LED circuit. As the transistor 136 switches between conducting and nonconducting states, the coil 134 is periodically energized and deenergized to cause the switch arm for the solenoid switch 132 to move back and forth between contacts 140 and 142. Each time the switch arm engages the contact 142, a circuit is completed to the light bulb 22 from the second power supply circuit 64 and the contact 130. This circuit is broken when the switch arm moves back to the contact 140, and thus the light bulb 22 will blink off and on when the horn 80 is energized. This will occur regardless of the manual position of the switch 66 as long as house power is present on the conductor 58.

It is often advantageous to provide a detector unit having a male electrical connector of a conventional type other than that of the socket mount of FIG. 2. For example, a detector with a conventional two or three prong male plug can be combined with a night-light or similar equipment and plugged into conventional household female receptacles. If it is desirable for the night-light to blink in response to an alarm condition, the circuit of FIG. 3 can be used, although it may be necessary to place a step down transformer in the line to the light 22 if a small night-light is used. For this use, a two prong plug would be provided to furnish power to the line 58 and to provide a ground line connection.

Figure 4:
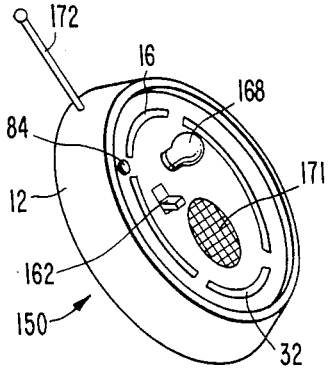
FIG. 4 is a perspective view of a second embodiment of the detector of the present invention.
Figure 5:
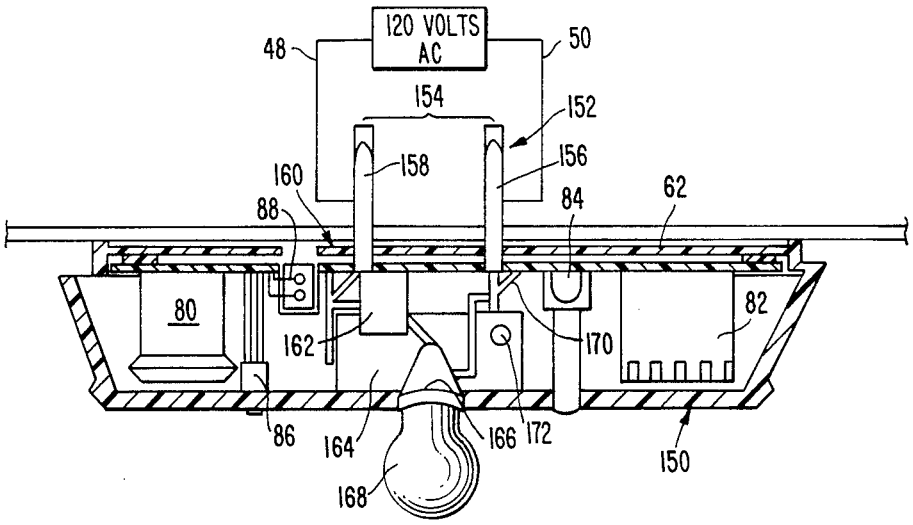
FIG. 5 is a sectional view of the detector of FIG. 4.

For night-light applications, it is normally not necessary for the light on the detector unit to blink in an alarm situation, and such a unit is indicated generally at 150 in FIGS. 4 and 5. Components of the detector 150 which are identical in structure and operation to those previously described with respect to the detector and light assembly 10 are identified by the same reference numerals previously employed.

The detector and night-light assembly 150 includes the housing 12, but instead of the projecting threaded mount and connector assembly 14, this unit includes a two prong male electrical connector 152 projecting from the back of the housing. When the two prong connector is received in a female socket 154, circuits are completed from a house building power supply over the lines 48 and 50 to prongs 156 and 158, respectively. Power from the prong 158 passes over split circuit lines 160 to the detector circuit board 62, a switch 162, and a sound transmitter unit 164, which will normally be a small radio transmitter. The switch 162 is connected to a first contact point on a socket 166 for a night-light bulb 168, and a return split circuit line 170 connects the socket 166, the detector circuit board 62 and the sound transmitter unit 164 to the prong 156 to complete the circuit to the power supply.

When the detector 150 is plugged into the female receptacle for a two or three pronged plug, the detector circuit is powered via the detector circuit board 62, and the night-light can be energized or deenergized by the operation of the switch 162. Often, night-light units are placed in the bedrooms of small children where it is desirable to monitor sound, and many inexpensive electrical sound transmitters and receivers are presently commercially available for this purpose. A sound transmitter of this type having an acoustic sound receiver 171 and an antenna 172 is mounted within the housing 12 to provide the sound transmitter 164. An opening may be provided in the wall 16 of the housing to facilitate the transmission of external sounds to the acoustic sound receiver and the sound transmitter 164 which are then retransmitted by the antenna 172 to a receiver in a room occupied by a child's parents.

Many babies and extremely small children, as well as infirm adults, are incapable of escaping from a room when the detector 82 activates the alarm horn 80, and in these situations, the detector 150 will prove invaluable. When the alarm horn 80 is activated, the sound is transmitted by the sound transmitter 164 to a receiver, which will normally be a small radio receiver, in another section of a house or building where persons are present who can respond to the alarm.

The detector unit 150 can be advantagouesly employed with the detector and light assembly 10 of FIGS. 1–3 when this assembly is provided with a sound receiver 174 as illustrated in FIG. 3. The sound receiver 174 is powered from the line 60 and includes an antenna 176 to receive the sounds transmitted by the sound transmitter 164. The sound receiver is a conventional unit adapted to receive and audibly reproduce the sounds transmitted by the sound transmitter.

Often, detectors are placed in a basement or a remote location where the sound of the horn 80 may not be immediately heard and identified by persons in other portions of a building or house. However, if the detector 150 is placed in the remote location and detectors 10 with the sound receiver 174 are placed in other locations, the sound of the horn 80 from the detector assembly 150 will be reproduced and retransmitted by the sound receiver in each detector and light assembly 10. Additionally, each detector and light assembly 10 which includes the transducer 108 can be activated by the sound from the sound receiver 174 as if the horn 80 in that unit had been activated, to cause the light bulb 22 to blink. Simultaneously, the audible alarm will be emitted by the sound receiver 174.

Figure 6:
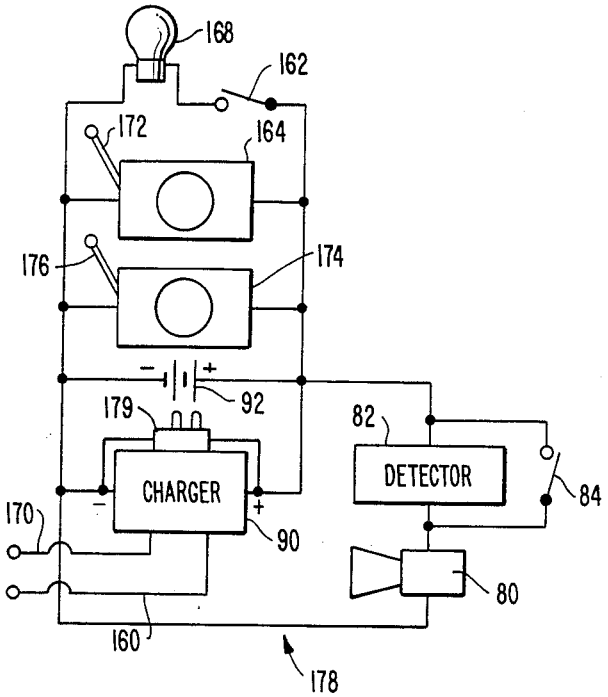
FIG. 6 is a circuit diagram of a third embodiment of the detector of the present invention.

FIG. 6 illustrates the circuit for a simplified detector unit 178. Here, the power and return lines 160 and 170 from the two prong plug 154 are connected directly to the battery charger 90. The battery 92 powers not only the detector 82 and the horn 80, but also the night-light 168, a sound transmitter 164 and a sound receiver 174. With this unit, the sound transmitter 164 transmits both sounds occuring in the vicinity of the detector unit 178 and alarm signals from the horn 80, while the sound receiver 164 reproduces sounds transmitted from other similar detector units or from a detector unit 150.

In the detector unit 178, the sound transmitter 164 and sound receiver 174 could be connected across the lines 160 and 170 rather than across the battery 92. However, with battery power, these units will continue to operate when the power supply across the lines 160 and 170 fails.

There are many commercially available plug-in battery charger units for kitchen and household applicances which are mounted on a wall having a two prong plug receptacle 154. The detector units 150 and 178, with or without the sound transmitter and receiver and the night-light 168, may be incorporated in such battery recharger units to provide a detector capability in locations where the charger units are plugged in. For these applications, the battery charger 90 may be provided with external connectors 179 so that a portable battery powered applicance may be connected to the charger for recharging. Alternatively, a second external appliance charger could be connected in parallel with the charger 90 across the lines 160 and 170.

Figure 7:
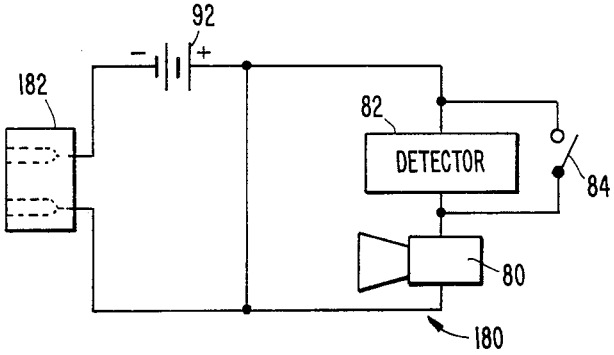
FIG. 7 is a circuit diagram of a fourth embodiment of the detector of the present invention.

FIG. 7 discloses a simple detector and alarm unit 180 which is adapted to plug into existing battery chargers for small appliances. Most of these battery chargers are mounted on a wall and are powered from a wall receptacle through a two prong plug and step down transformer. The charger is mounted in a holder for the appliance, and the applicance is connected to the charger by two male prongs which project from the holder and are electrically connected to the charger. A female receptacle for the m ale prongs of the appliance charger are mounted on the rear of the housing 12 for the detector 180, and connect the charger across the battery 92. Thus the detector 180 may be plugged into a conventional wall mounted appliance charger to provide detection when the appliance is not recharging.

Figure 8:
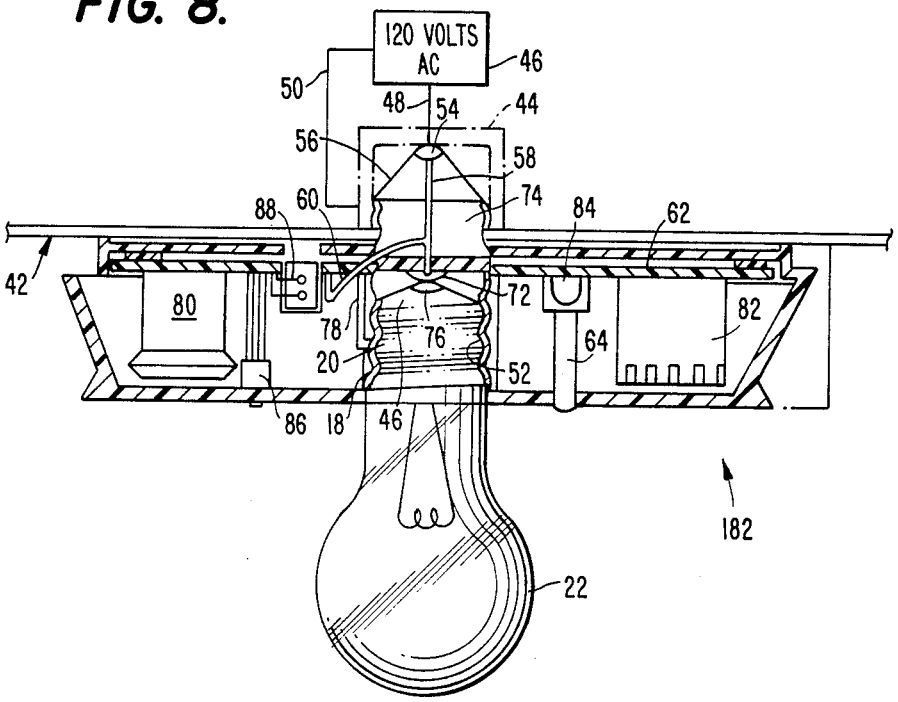
FIG. 8 is a partially diagrammatic sectional view of a fifth embodiment of the detector with combination lamp and alarm of the present invention.
Figure 9:
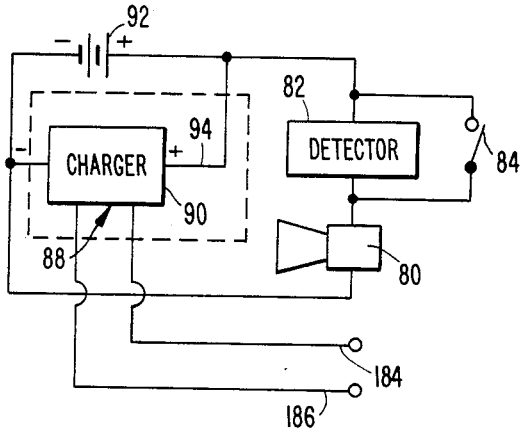
FIG. 9 is a circuit diagram for the detector of FIG. 8.
Figure 10:
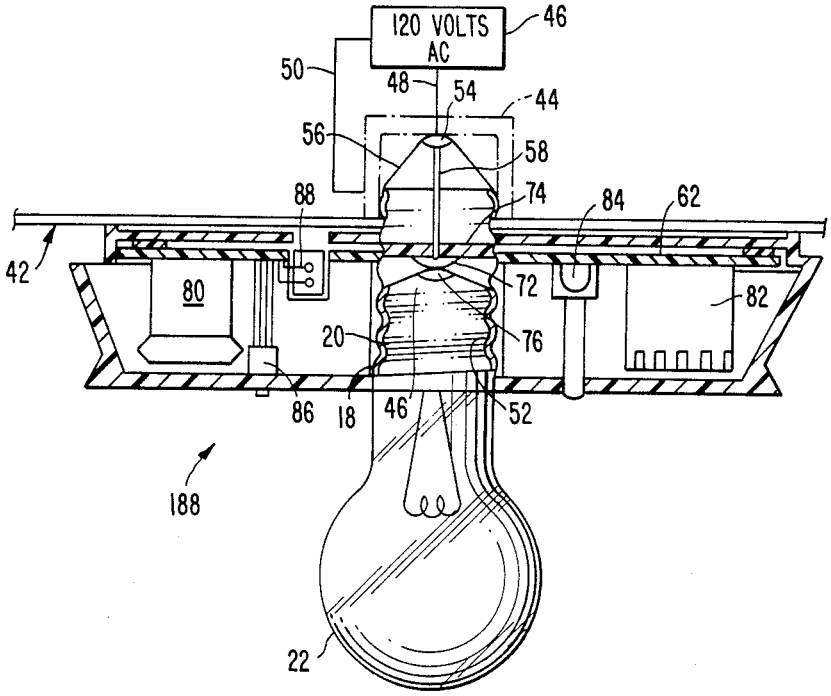
FIG. 10 is a partially diagrammatic sectional view of a sixth embodiment of the detector with combination lamp and alarm of the present invention.

For some household applications, it is desirable to provide a detector with light assembly which will mount in a conventional ceiling light fixture in the same manner as previously described in connection with the detector with light assembly 10, but wherein the light bulb 22 will be controlled by a conventional wall switch. FIGS. 8–10 disclose assemblies of this type, and in these figures, structural elements which are identical in structure and function to those illustrated in FIGS. 1–3 will be designated by like reference numerals.

Referring now to FIG. 8, a detector and light assembly 182 is illustrated which is quite similar to the assembly of FIGS. 1 and 2, with the exception that the switch 66, 68 is eliminated and the conductor 58 from the fixture contact 54 provides power directly to the first power supply circuit 60 and also to the bulb socket contact 72. Thus, a wall switch (not shown) which controls the provision of power to the power supply 46 can be used to energize and deenergize the light bulb 22 over the circuit provided by the conductor 48, the fixture contact 54, the conductor 58, and the bulb socket contact 72 to the bulb contact 76, and then from the conductive sidewall 52 over the line 50 to the power supply. The detector and light assembly 182 may incorporate the circuit of FIG. 3 with the contacts 66 and 128 being normally closed and not provided with a manual actuator. With this circuit, the light bulb 22 would blink in an alarm condition only if the light had been left energized from the controlling wall switch. Also, the battery charger 90 would receive power to charge the battery 92 only when the light bulb 22 is energized, and for the remainder of the time, the battery circuit 88 is powered by the battery 92.

It is often desirable to replace the circuit of FIG. 3 with the simplified battery circuit 88 of FIG. 9. Here, input terminals 184 and 186 connect the battery charger 90 to the lines 60 and 78, respectively. When the light bulb 22 is energized, the battery charger 90 will charge the battery 92, and when the light bulb is not energized, the battery circuit 88 operates on battery power.

In FIG. 10, a detector and light assembly 188 is shown where only the light bulb 22 is energized from the power supply 46. In this construction, the power supply 46 is controlled by a conventional light switch, and similar to the detector and light assembly 182, the conductor 58 is connected directly from the fixture contact 54 to the bulb socket contact 72. However, here the conductors 60 and 78 are eliminated as well as the conductors 64 and 70 and the switch 66, 68.

Since no power is provided from the power supply 46 to the battery circuit 88, the battery circuit must operate either solely on battery power or must be connected to a separate power supply. If battery power is the sole supply source, the terminals 184 and 186, the battery charger 90 and the terminal 94 will be eliminated as indicated in broken lines in FIG. 9. Now the battery 92 will directly power the horn 80 and detector 82.

Alternatively, the battery charger 90 can remain as shown in FIG. 9 and the terminals 184 and 186 may be hard wired or otherwise connected to a separate household power source which is not controlled by the wall switch that controls the power supply 46.

INDUSTRIAL APPLICABILITY

The detector with light assembly of the present invention may be removably installed in any conventional electrical receptacle and operated simultaneously as an electric light and a rechargeable battery operated detector. The assembly includes a light control switch to facilitate manual operation of a light, but in an alarm condition, the light may be automatically switched to a blinking mode so that the unit provides both a visual and an audible alarm. The assembly can incorporate sound transmitters and/or receivers to permit it to interact with other detectors or with separate sound receivers.

I claim:

1. A detector assembly adapted to be removably secured to a female electrical receptacle connected to a power supply comprising:

support means, electrically powered alarm circuit means mounted upon said support means and operable when activated to provide an audible alarm, detector means mounted upon said support means, said detector means being connected to said alarm circuit means and operating in response to an alarm condition to activate said alarm circuit means, a male electrical connector and mounting means secured to said support means and extending outwardly therefrom to form the sole mounting support for said support means, said male electrical connector and mounting means being configured to be removably engageable in said female electrical receptacle and being operative to complete an electrical circuit therewith to receive power therefrom, and power circuit means operative to provide a circuit between said male electrical connector and mounting means and said electrically powered alarm circuit means and to provide power from said male electrical connector and mounting means to said electrically powered alarm circuit means when said male electrical connector and mounting means receives power from said female electrical receptacle.

2. The detector assembly of claim 1, wherein said male electrical connector and mounting means includes an electrical plug unit having at least two spaced conductive prongs projecting from said support means.

3. The detector assembly of claim 2, which includes light bulb receiving socket means mounted upon said support means, said light bulb receiving socket means being operative to receive and provide power to an electric light bulb, and second power circuit means operative to complete a circuit between said light bulb receiving socket means and said electrical plug unit to provide power from said electrical plug unit to a light bulb mounted in said light bulb receiving socket means when said electrical plug unit completes an electric circuit with said female electrical receptacle.

4. The detector assembly of claim 3, wherein said second power circuit means includes switching means which is manually operable to complete or break a circuit between said electrical plug unit and said light bulb receiving socket means.

5. The detector assembly of claim 1, wherein said support means includes a housing which encloses said alarm circuit means and said power circuit means, said male electrical connector and mounting means extending outwardly from a first side of said housing and said light bulb receiving socket means opening from a second side of said housing opposite to said first side.

6. The detector assembly of claim 5, wherein said electrically powered alarm circuit means includes a battery charger means connected to receive power from said power circuit means, a battery, and an alarm means, said detector means being connected between said battery and said alarm means and operating to connect said battery to said alarm means in response to an alarm condition, said battery charger means operating to provide charging power to said battery.

7. The detector assembly of claim 1, wherein said electrically powered alarm circuit means includes a battery charger means connected to receive power from said power circuit means, a battery and an alarm means, said detector means being connected between said battery and said alarm means and operating to connect said battery to said arm means in response to an alarm condition, said battery charger means operating to provide charging power to said battery and including external connector means extending therefrom to mate with a connector on an electrical battery powered appliance to be charged, said battery charging means operating to charge an electrical battery powered appliance when said connector therefor is mated with said external connector means.

8. The detector assembly of claim 7, wherein said male electrical connector and mounting means includes an electrical plug unit having at least two spaced conductive prongs projecting from said support means.

9. The detector assembly of claim 1, which includes an electrically powered sound transmitting means mounted upon said support means, said electrically powered sound transmitting means including acoustic means to receive sounds in the area of said detector assembly, said sound transmitting means operating to transmit sounds received by said acoustic means to a remote receiver, said power circuit means operating to provide power from said male electrical connector and mounting means to said electrically powered sound transmitting means.

10. The detector assembly of claim 9, which includes light bulb receiving socket means mounted upon said support means, said light bulb receiving socket means being operative to receive and provide power to an electric light bulb, said power circuit means operating to provide power from said male electrical connector and mounting means to said light bulb receiving socket means.

11. The detector assembly of claim 10, wherein said support means includes a housing which encloses said alarm circuit means and said power circuit means, said male electrical connector and mounting means extending outwardly from a first side of said housing and said light bulb receiving socket means opening from a second side of said housing opposite to said first side.

12. The detector assembly of claim 11, wherein said male electrical connector and mounting means includes an electrical plug unit having at least two spaced conductive prongs.

13. A detector assembly adapted to be removably secured to an electrical power connector connected to a power supply and designed to mate with an opposing electrical connector means comprising:

support means, electrically powered alarm circuit means mounted upon said support means and operable when activated to provide an audible alarm, detector means mounted upon said support means, said detector means being connected to said alarm circuit means and operating in response to an alarm condition to activate said alarm circuit means, and an opposing electrical connector means secured to said support means to form the sole mounting support for said support means, said opposing electrical connector means being configured to be removably engageable with said electrical power connector and being operative to complete an electrical circuit therewith to receive power therefrom.

14. The detector assembly of claim 13, wherein said power supply includes a battery charger having said electrical power connector mounted thereon, and power circuit means being operative to provide power from said opposing electrical connector means to said electrically powered alarm circuit means when said opposing electrical connector means is engaged with said electrical power connector, said electrically powered alarm circuit means including a battery connected to receive charging power from said power circuit means, and an alarm means, said detector means being connected between said battery and said alarm means and operating to connect said battery to said alarm means in response to an alarm condition.

15. The detector assembly of claim 13, which includes an electrically powered sound transmitting means mounted upon said support means, said electrically powered sound transmitting means including acoustic means to receive sounds in the area of said detector assembly, said sound transmitting means operating to transmit sounds received by said acoustic means to a remote receiver.

16. The detector assembly of claim 14, which includes a power circuit means operative to provide a circuit between said opposing electrical connector means and said electrically powered sound transmitting means to provide power from said opposing electrical connector means to said electrically powered sound transmitting means when said opposing electrical connector means receives power from said electrical power connector.

17. The detector assembly of claim 13, which includes electrically powered receiver means mounted upon said support means, said electrically powered receiver means operating to receive alarm signals transmitted by a remote transmitter and upon receipt of said alarm signals to activate said alarm circuit means.

18. The detector assembly of claim 13, which includes light bulb receiving socket means mounted upon said support means, said light bulb receiving socket means being operative to receive and provide power to an electric light bulb, and power circuit means operative to complete a circuit between said light bulb receiving socket means and said opposing electrical connector means to provide power from said opposing electrical connector means to said light bulb receiving socket means when said opposing electrical connector means completes an electrical circuit with said electrical power connector.

19. The detector assembly of claim 18, wherein said support means includes a housing which encloses said alarm circuit means and said power circuit means, said opposing electrical connector means extending outwardly from a first side of said housing and said light bulb receiving socket means opening from a second side of said housing opposite to said first side.

20. The detector assembly of claim 19, wherein said electrically powered alarm circuit means includes a battery and an alarm means, said detector means being connected between said battery and said alarm means and operating to connect said battery to said alarm means in response to an alarm condition.

21. A detector assembly adapted to be removably secured to an electrical power connector connected to a power supply and designed to mate with an opposing electrical connector comprising:

support means, an electrically powered light circuit means mounted upon said support means, said light circuit means including light bulb receiving socket means to receive an electric light bulb, said electrically powered light circuit means being operable when activated to provide power to light said light bulb, detector means mounted upon said support means, said detector means being operable in response to a sensed condition to activate said electrically powered light circuit means, and an opposing electrical connector means secured to said support means to form the sole mounting support for said support means, said opposing electrical connector means being configured to be removably engageable with said electrical power connector and being operative to complete an electrical circuit therewith to receive power therefrom.

22. The detector assembly of claim 21, wherein said opposing electrical connector means includes a male electrical connector secured to said support means and extending outwardly therefrom, said electrical power connector including a female electrical receptacle adapted to receive said male electrical connector.

23. The detector assembly of claim 22, wherein said support means includes a housing which encloses said detector means and said electrically powered light circuit means, said male electrical connector extending outwardly from a first side of said housing and said light bulb receiving socket means opening from a second side of said housing opposite to said first side.

24. The detector assembly of claim 23, wherein said female electrical receptacle is a threaded, incandescent light socket, said light bulb receiving socket means is a threaded female incandescent light socket, and said male electrical connector and mounting means is a single projecting, externally threaded connector dimensioned to be screw threaded into said female electrical receptacle.

25. The detector assembly of claim 24, wherein said light bulb receiving socket means is mounted on said support means in spaced relationship to said male electrical connector.

26. The detector assembly of claim 21, wherein said electrically powered light circuit means includes switching means connected between said male electrical connector and said light bulb receiving socket means to make or break an electrical circuit therebetween.

27. The detector assembly of claim 26, wherein said switching means operates in response to the operation of said detector means in response to said sensed condition to complete an electrical circuit between said male electrical connector and said light bulb receiving socket means.

28. The detector assembly of claim 22 which includes power circuit means to provide power from said male electrical connector to said detector means.

* * * * *